US007671762B2

(12) United States Patent
Breslau et al.

(10) Patent No.: US 7,671,762 B2
(45) Date of Patent: Mar. 2, 2010

(54) SYSTEM AND METHOD FOR TRANSCEIVING MOTOR VEHICLE DATA

(75) Inventors: Franklin C. Breslau, Teaneck, NJ (US); John P. Kaemmerer, Pflugerville, TX (US)

(73) Assignee: International Business Machines Corporation, Armonk, NY (US)

( * ) Notice: Subject to any disclaimer, the term of this patent is extended or adjusted under 35 U.S.C. 154(b) by 484 days.

(21) Appl. No.: 11/555,761

(22) Filed: Nov. 2, 2006

(65) Prior Publication Data

US 2008/0106439 A1 May 8, 2008

(51) Int. Cl.
*G08G 1/123* (2006.01)

(52) U.S. Cl. ..... 340/988; 340/904; 340/917; 340/933; 340/10.42

(58) Field of Classification Search ..... 340/988, 340/995.1, 426.1, 426.19, 431, 426.16, 904, 340/917, 928, 933, 10.1, 10.42; 701/1, 35, 701/200

See application file for complete search history.

(56) References Cited

U.S. PATENT DOCUMENTS

| | | | | |
|---|---|---|---|---|
| 6,330,499 | B1 * | 12/2001 | Chou et al. | 701/33 |
| 6,751,475 | B1 * | 6/2004 | Holmes et al. | 455/557 |
| 6,985,089 | B2 * | 1/2006 | Liu et al. | 340/903 |
| 6,985,717 | B1 | 1/2006 | Yoshioka | |
| 6,996,397 | B2 * | 2/2006 | Fraser et al. | 455/426.1 |
| 7,015,800 | B2 * | 3/2006 | Lesesky et al. | 340/431 |
| 7,102,492 | B2 * | 9/2006 | Weber | 340/426.1 |
| 7,355,510 | B2 * | 4/2008 | Rockett et al. | 340/426.19 |

* cited by examiner

*Primary Examiner*—Davetta W Goins
(74) *Attorney, Agent, or Firm*—Cantor Colburn LLP; William Steinberg

(57) ABSTRACT

A system and method for transceiving vehicle data is provided. The system and method provide for transceiving situation data to or from a vehicle. The system includes a situation data generator for generating the situation data and a transceiver for transmitting the situation data. The system also includes a database for storing the transmitted situation data and a display for displaying the transmitted situation data. Further, a system for storing situation and/or vehicle identification data for real time or later analysis is also disclosed.

6 Claims, 3 Drawing Sheets

SYSTEM AND METHOD FOR TRANSCEIVING MOTOR VEHICLE DATA

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to transceiving vehicle data in general and, in particular, to manually and automatically transceiving specific vehicle operational status.

2. Description of the Related Art

An emergency informing apparatus mounted on a vehicle for informing emergency condition data, position data, and identification data of the vehicle in response to a command signal is known. Such a prior art emergency informing apparatus informs police, etc. of at least emergency condition data, position data, and identification data of the vehicle in response to a switch.

However, though the prior art emergency informing apparatus includes a wireless telephone communication circuit, it cannot be used for general personal communication or for transmitting vehicle situation data and/or storing vehicle data for later analysis.

SUMMARY OF THE INVENTION

In accordance with one embodiment of the present invention, the shortcomings of the prior art are overcome and additional advantages are provided through the provision of a method for receiving and storing vehicle data from another vehicle. The method includes receiving from the vehicle, situation data. The situation data may include receiving motor vehicle identification data (VID) associated with the motor vehicle. The method also includes time stamping the received VID data; and storing the received data.

The invention is also directed towards a system for transceiving situation data to or from a vehicle. The system includes a situation data generator for generating the situation data and a transceiver for transmitting the situation data. The system also includes a database for storing the transmitted situation data and a display for displaying the transmitted situation data.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution which a computer program product stored on machine readable media for executing machine readable instructions is provided and performs a method for receiving and storing vehicle data from a first vehicle. The method includes receiving situation data from a vehicle. Receiving the situation data may include receiving motor vehicle identification data (VID) associated with the motor vehicle. The VID data may also include a vehicle identification number (VIN) and motor vehicle registration data. The method also determines geographical position data (GPD) associated with the motor vehicle. Determining GPD associated with the motor vehicle further may include receiving global positioning satellite data (GPS) data associated with the motor vehicle and/or determining GPD from at least one stationary receiver. The method further includes time stamping the received VID data and storing the received VID data in a relational database.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
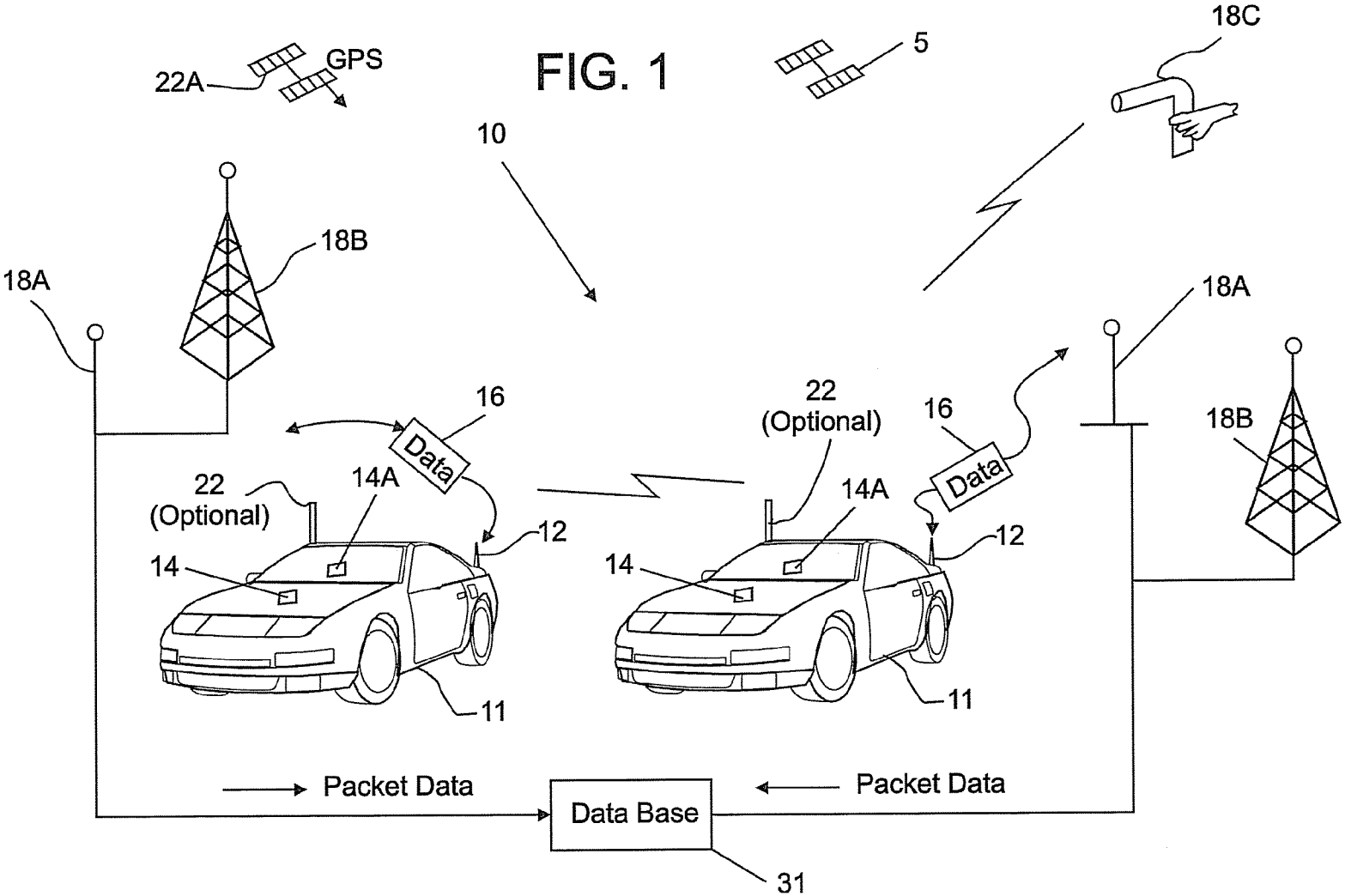
FIG. 1 depicts aspects of a motor vehicle data transceiving system for implementation of the teachings herein.

Referring now to FIG. 1, an embodiment of a motor vehicle data transceiving system 10 is shown. A motor vehicle 11 may be any suitable vehicle, such as an automobile, motorcycle, or truck. In general, the motor vehicle 11 will be a vehicle regulated by a local, state or federal government. It will be appreciated that the motor vehicle may also be a marine vessel, likewise regulated by the local, state or federal government.

The onboard computer 14 may be any suitable computer for determining vehicle faults and/or status, such as, for example: low tire pressure, bulbs or signals inoperative, low oil pressure, anti-lock brakes are inoperative, and so on. The onboard computer 14 may also contain logic and resources necessary to store data, such as non-volatile memory, for later download and/or analysis. It is understood that the onboard computer 14 also includes the circuitry required for implementing the logic functions of the onboard computer 14. By way of example, the onboard computer 14 may be comprised of a digital signal processor device, a microprocessor device, and various analog to digital converters, digital to analog converters, and other support circuits.

Fault display 14A may be any suitable display for displaying faults determined by on board computer 14, or alerts received by transceiver 12 such as, for example, an LED display.

Transceiver 12 may be any suitable transceiver, omni or uni-directional, for transmitting or receiving data. It will be appreciated that the transceiver 12 may operate with any suitable communications technology such as, for example, code division multiple access (CDMA) or time division multiple access (TDMA). It will further be appreciated that the transceiver 12 may contain the logic and resources necessary to communicate with a cellular telephone base. Examples of data transmitted by transceiver 12 include, but are not limited to; bright headlights are on; turn signal unnecessarily on, brake lights appear inoperative, low or flat tire, or that a collision appears imminent.

Receiver 22 is a Global Positioning Satellite (GPS) receiver for receiving GPS data associated with the geographical position of the motor vehicle and reporting the GPS data to the onboard computer 14.

Land receiver 18A is any suitable land receiver, or receivers, for receiving and/or querying motor vehicle 11 via its respective transceiver 12 for motor vehicle identification data (VID). VID may be any suitable data describing the motor vehicle. For example, VID data may include Vehicle Identification Number (VIN) data; local, state, or federal registration information; and optionally, vehicle status, e.g., bulb failure. It will be appreciated that land receiver 18A may operate with any suitable communications technology, such as, for example, code division multiple access (CDMA) or time division multiple access (TDMA). It will also be understood that land receiver 18A may contain the logic and resources necessary for time stamping received data. It will further be appreciated that the land receiver 18A may contain the logic and resources necessary to communicate with a cellular telephone base.

It will be further understood that land receivers 18A may receive data 16 concurrently and may contain the logic and resources necessary to temporally and spatially locate the motor vehicle transmitting data 16.

Similarly, handheld device 18C may also receive and/or query motor vehicle 11 via its respective transceiver 12 for motor vehicle identification data (VID). It will also be understood that handheld device 18C may operate with any suitable communications technology, such as, for example, code division multiple access (CDMA) or time division multiple access (TDMA). It will be further understood that land receiver 18AC may contain the logic and resources necessary for time stamping received data. It will further be appreciated that the handheld device 18C may contain the logic and resources necessary to communicate with a cellular telephone base.

Data 16 may be any suitable data stream for transmitting vehicle situation, status, vehicle identification, vehicle position, or course; and time and date of transmission.

Satellite 5 may be any suitable satellite or satellite constellation such as a low earth orbit (LEO) satellite constellation. Satellite 5 may receive or transmit vehicle data from the motor vehicle 11, land receivers 18A, and/or cellular telephone base 18B.

Cellular telephone base 18B may be any suitable base station, generally part of a base station network. Cellular telephone base 18B may operate with any suitable cellular telephone technology such as the aforementioned CDMA and/or TDMA.

Likewise, global positioning system (GPS) satellite 22A may be any suitable satellite system.

Database 31 may be any suitable database for storing time stamped VID data associated with any particular motor vehicle 11. It will be understood that database 31 may be geographically dispersed to level processing loads. It will be further understood that database 31, when considered as a whole, will contain the logic and resources necessary to store data on the order of terabytes or more. It will also be understood that the database 31 will contain the logic and resources necessary to rapidly query the database in case of an AMBER alert or a terrorist alert. It will also be understood that the database 31 will contain the logic and resources necessary to analyze the stored data for patterns relating to traffic control, commerce, and suspected terrorist activities.

Figure 2:
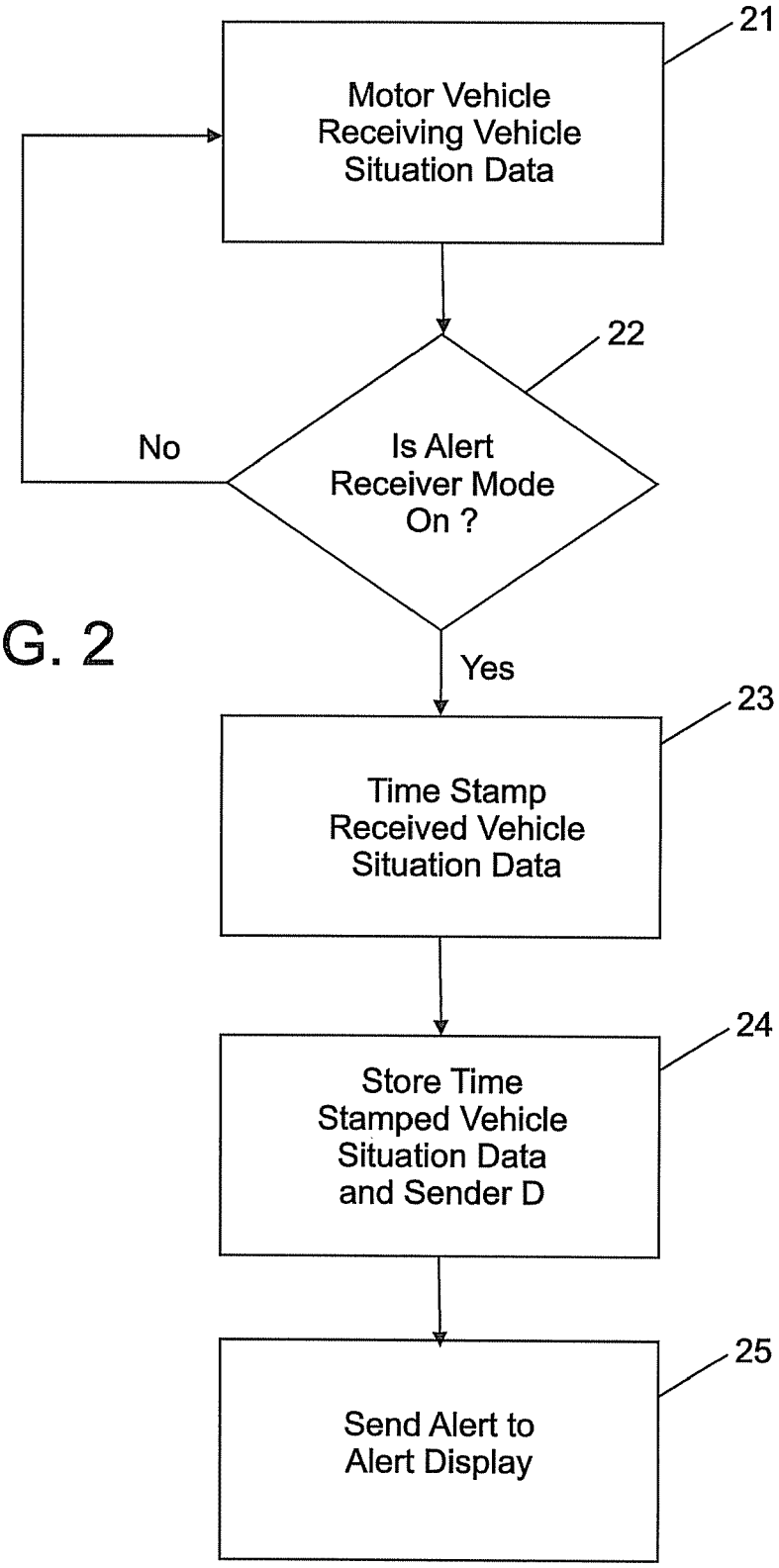
FIG. 2 illustrates a method for a motor vehicle receiving situation data in accordance with the invention shown in FIG. 1.

Referring also to FIG. 2, there is shown a method for a motor vehicle receiving situation data in accordance with the invention shown in FIG. 1. Motor vehicle 11 receives 21 motor vehicle situation data. The data may have been transmitted by another motor vehicle or a land based transceiver. The motor vehicle situation data may include any relevant situation data, for example, but not limited to: turn signals inoperative, flat or low tire pressure, or traffic congestion ahead.

If motor vehicle 11 alert receiver mode is on 22 the received data is time stamped 23 and stored 24 by on board computer 14, along with sender ID. The alert is sent 25 to alert display such as 14A.

Figure 3:
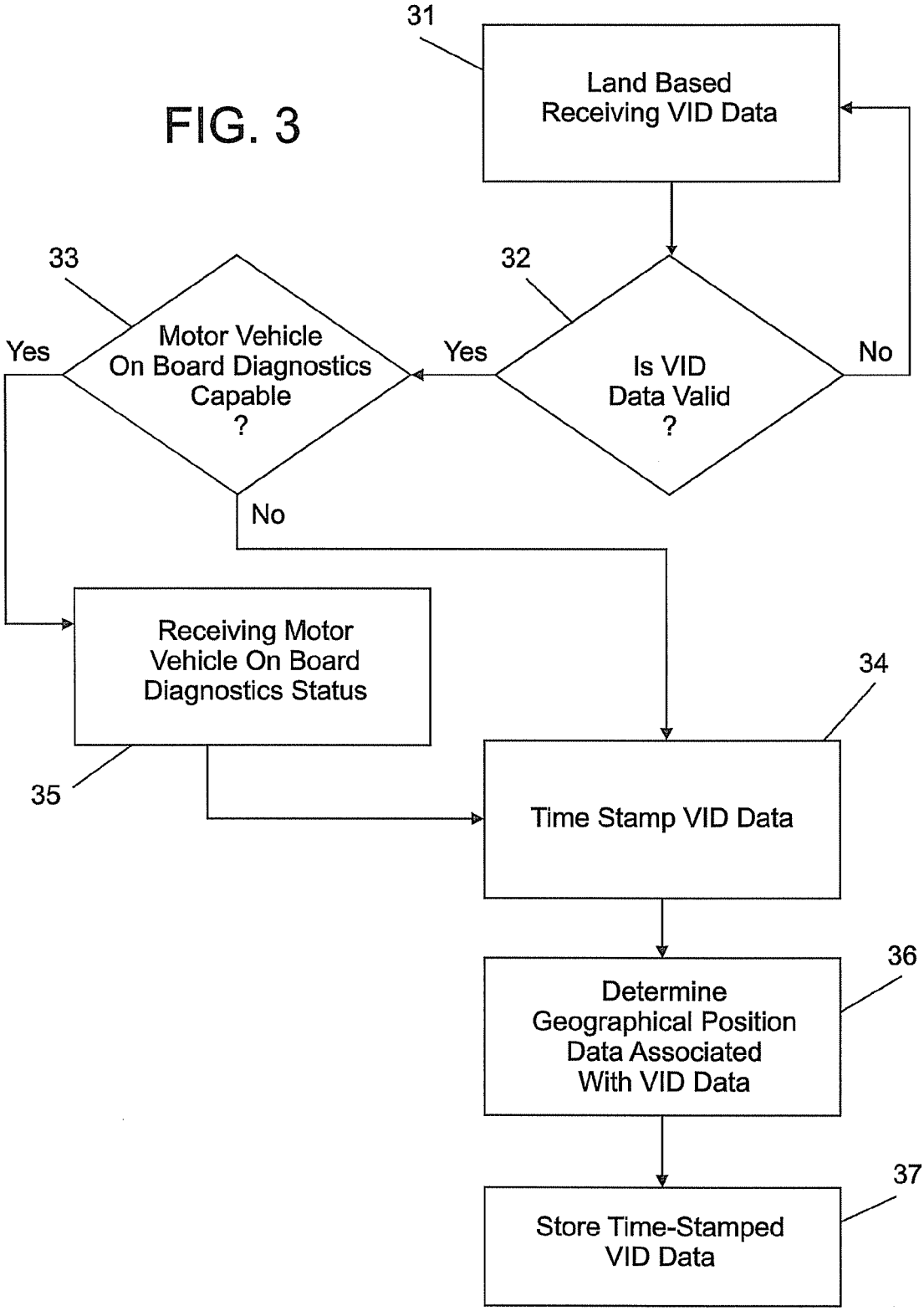
FIG. 3 illustrates another method for a land based receiver receiving situation and/or Vehicle Identification Data in accordance with the invention shown in FIG. 1.

Referring to FIG. 3 (and FIG. 1), there is shown another method for a land based receiver receiving situation and/or Vehicle Identification Data in accordance with the invention shown in FIG. 1. Land based receiver 18A, 18B, or 18C receives 31 VID data from motor vehicle 11. A check such as a cyclic redundancy check (CRD) or any other suitable check verifies 32 VID validity. If the motor vehicle 11 has on board capability 33 the land based receiver also receives 35 on board diagnostic status indicators. The data is time stamped 34 and motor vehicle 11 geographical position is determined 36. The geographical position may be determined from GPS data or calculated from multiple receiver locations, e.g., triangulation. The data is stored 37 in database 31 for query and/or analysis.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. For example, features may include; can activate or disable wireless communication of the device, wirelessly can receive new/updated conditions to choose from, has method to scroll through and select from a list of conditions that are displayed on LED or some display. Once selected, the user has a way to identify which cars are nearby and then choose one based on strength of signal, GPS position of vehicle with respect to user's, by typing or showing short text (like maybe a license plate number or car make./model/color based on the VIN), or some other way. Besides sending to an individual vehicle, could also send to all vehicles nearby (maybe the driver wants to notify others of traffic accident or highway congestion up ahead). In addition, the capability to log the VIN of the sending vehicle and the ability to validate that the sending vehicle VIN is not stolen.

Likewise, via a user's password (or other security implementation such as fingerprint or voice recognition), the user can keep the device active or disabled so that a criminal cannot change the setting. So if someone steals your device, it cannot be turned off if you had it on. Thus it could be sending VIN or other vehicle information to other vehicles that pass near it. This could be used during "Amber alerts" so that certain vehicles could be located by having a warning light/LED code flash on the receiving car's dashboard or separate device that a suspicious vehicle has been spotted. Thus, these claims should be construed to maintain the proper protection for the invention first described.

What is claimed is:

1. A system for transceiving situation data to or from a motor vehicle, the system comprising:

a situation data generator for generating the situation data;

a transceiver for transmitting the situation data, wherein the transceiver further comprises a receiver for receiving a second situation data, wherein the situation data generator further comprises a motor vehicle identification (VID) generator;

a land database separate from the vehicle for storing the transmitted situation data, the database being remotely located from the vehicle, the database accessed by a land receiver separate from the vehicle, the land receiver verifying that the VID data is valid prior to storing the situation data in the database; and a display for displaying the transmitted situation data.

2. The system as in claim 1 wherein the situation data generator further comprises an input device for entering the situation data.

3. The system as in claim 1 wherein the situation data generator further comprises a global positioning satellite (GPS) system.

4. The system as in claim 1 further comprising:

a second database for storing the received second situation data; and a second display for displaying the received second situation data.

5. The system as in claim 1, wherein the land receiver comprises at least one cellular telephone base station.

6. A program storage device readable by a machine, tangibly embodying a program of instructions executable by the machine to perform a method for receiving and storing motor vehicle data from a motor vehicle, the method comprising:

at a land receiver separate from the vehicle, receiving from the motor vehicle at least one motor vehicle data, wherein receiving the at least one motor vehicle data comprises:

receiving motor vehicle identification data (VID) associated with the motor vehicle, wherein upon the land receiver verifying that the VID data is valid, the receiving from the motor vehicle at least one motor vehicle VID data further comprises:

receiving a vehicle identification number (VIN);

receiving motor vehicle registration data;

determining geographical position data (GPD) associated with the motor vehicle, wherein determining GPD associated with the motor vehicle further comprises:

receiving global positioning satellite data (GPS) data associated with the motor vehicle;

at least one stationary receiver determining GPD;

time stamping the received VID data; and storing the received VID data, wherein storing the received VID data comprises storing the received VID data in a relational database.

* * * * *